US007475805B2

(12) United States Patent
Visser

(10) Patent No.: US 7,475,805 B2
(45) Date of Patent: Jan. 13, 2009

(54) PRIMARY CONTAINER FOR A SECURITY SYSTEM

(76) Inventor: Jan Willem Visser, 12 Collins Street, Edenglen, Edenvale (ZA) 1609

( * ) Notice: Subject to any disclaimer, the term of this patent is extended or adjusted under 35 U.S.C. 154(b) by 0 days.

(21) Appl. No.: 10/588,882

(22) PCT Filed: Feb. 9, 2005

(86) PCT No.: PCT/ZA2005/000034

§ 371 (c)(1),
(2), (4) Date: Jun. 15, 2007

(87) PCT Pub. No.: WO2005/076232

PCT Pub. Date: Aug. 18, 2005

(65) Prior Publication Data

US 2007/0272731 A1 Nov. 29, 2007

(30) Foreign Application Priority Data

Feb. 9, 2004 (ZA) ..... 2004/1033

(51) Int. Cl.
*A45C 1/12* (2006.01)

(52) U.S. Cl. ..... 232/1 D; 383/5; 109/25

(58) Field of Classification Search ..... 232/1 D; 383/5, 38; 206/807, 219; 109/25, 29
See application file for complete search history.

(56) References Cited

U.S. PATENT DOCUMENTS 4,722,435 A * 2/1988 Mareels et al. ..... 206/1.5
4,799,435 A * 1/1989 Boutroy ..... 109/25
5,077,001 A * 12/1991 Makowka ..... 383/5
5,293,990 A * 3/1994 Masakayan ..... 206/1.5
5,727,686 A * 3/1998 Kristal ..... 206/459.1
6,536,348 B1 * 3/2003 Gral ..... 102/293
7,121,215 B2 * 10/2006 Besnard ..... 109/25
2002/0130777 A1 * 9/2002 Besnard ..... 340/568.7
2007/0272731 A1 * 11/2007 Visser ..... 232/1 D

FOREIGN PATENT DOCUMENTS

EP 1462021 * 9/2004

* cited by examiner

*Primary Examiner*—Wiliam L. Miller
(74) *Attorney, Agent, or Firm*—Colin P. Abrahams

(57) ABSTRACT

A tamper evident primary container (20) for storing and/or transporting valuables, particularly currency and other documents comprises an envelope (14) with tamper evident features and a partition for dividing the envelope into first (30) and second portions (32) that communicate with each other through at least one path. A first opening (22) in the envelope is provided through which articles can be inserted into the first portion and a seal for sealing the first opening is provided. A second opening (36) opens into the second portion through which a staining medium can be introduced into the second portion when desired. The path is constructed and arranged so as at least to inhibit access to the first portion through the second portion and to indicate tampering if access is breached. The partition is intermittent to form a plurality of paths that can permit a staining medium to be dispensed into the first portion through the second portion.

20 Claims, 2 Drawing Sheets

PRIMARY CONTAINER FOR A SECURITY SYSTEM

TECHNICAL FIELD

This invention relates to a primary container for a security system to store and/or transport valuable articles, particularly though not exclusively, currency and other bearer documents.

BACKGROUND ART

It is well known to store and transport valuable articles, such as documents, minerals, currency, examination papers and the like, in a tamper evident, sealable plastics bag or primary container. Typically, the primary container is of an appropriate polyolefin that has desired characteristics and that bonds firmly with a strip of suitable adhesive. It is also known to protect a primary container, of any type, further by placing it in a secondary container that, depending on the nature of the articles being secured, has devices that can be activated to stain/damage the articles as well as indicate compromised security, such as visual/audible alarm signals and wireless tracking signals. The staining or damaging medium may be a powder, liquid, solid, gas or heat. Secondary containers are expensive and thus mostly used only to secure primary containers temporarily between collection and deposit points, such as a business and a suitable protected, secured or armoured courier vehicle.

The terms "stain" and "staining" as used herein refers to damaging, staining, marking, defacing and the like functions to render valuable articles, particularly currency and bearer documents, untradable. While tamper evident plastics primary containers provide acceptable protection against tempering, they are not suited for staining because the polyolefin is impregnable to known staining media. Secondary containers thus usually rely on a combination of heat to shrink or burn holes in the primary containers to allow access for staining. Although such systems have been used internationally for many years, it is known that their effectiveness is variable.

Significantly, the heat source is potentially dangerous at all times—fatalities and fires have been reported—and when used destroys the expensive secondary container.

Thus this invention seeks to provide a primary container for use within secondary containers and with staining systems that ensures acceptable staining of currency in a manner that resolves the inadequacies of the known systems mentioned above in a reasonably satisfactory manner.

DISCLOSURE OF THE INVENTION

One aspect of the invention provides a method of securing valuable articles within a tamper evident primary container, including the steps of:

partitioning the primary container into first and second portions that communicate with each other through at least one path arranged to prevent undetectable access to the first portion through the second portion;

inserting articles to be secured into the first portion and sealing at least that portion; and selectively dispensing a staining medium into the second portion from where it can flow into the first portion through the path.

Another aspect of the invention provides a primary container for articles to be secured comprising:

an envelope with tamper evident features, optionally made from a suitable plastics material;

means partitioning the envelope into first and second portions that communicate with each other through at least one path;

a first opening in the envelope through which articles can be inserted into the first portion;

means for sealing the first opening; and a second opening into the second portion through which a staining medium can be introduced into the second portion when desired.

This aspect of the invention also provides a primary container for articles to be secured comprising an envelope with tamper evident features, a first opening through which articles can be inserted into the envelope, and means for sealing the first opening, wherein partitioning means is provided to separate the envelope into first and second portions that communicate with each other through at least one path; and a second opening is formed into the second portion through which a staining medium can be introduced into the second portion when desired.

The path is constructed and arranged so as to prevent or inhibit access to the first portion through the second portion or to ensure that such access is detectable.

Preferably the envelope is substantially rectangular, the first opening extends substantially parallel to one pair of opposed edges and the partitioning means extends substantially parallel to the other pair of opposed edges. Other shapes may also be used, such as round, oval, square and the like.

Preferably the partitioning means extends substantially from one of the edges to the opposite edge.

Preferably, a plurality of spaced apart paths are formed through the partitioning means between the first and second portions. This facilitates the flow of staining medium between the portions.

In one form of the invention the paths are formed by an intermittent seam line, formed by welding, stitching, bonding and the like. The breaks in the seam form openings or flow paths. The openings may be sufficiently small and of substantially similar size, such as 2 to 20 mm, preferably between 2 and 10 mm, in order to inhibit inserting implements through them to snag and roll currency and then withdraw it through the openings. Alternatively, the openings may increase in size in a direction away from the opening to the second portion—again this is to ensure maximum flow of staining medium between the second and first portions. It is envisioned that such openings can range in size from 2 to 50 mm, though 2 to 20 mm is preferred. For this reason, preferably the partitioning means is substantially continuous from the edge adjacent the second opening for a desired length and then is formed with the spaced openings to form the spaced apart paths. This arrangement, when properly configured having regard to the size of the slit in the second portion, the width of the second portion and the dimension of the openings, ensures that attempts to insert probes into the first portion through the slit and second portion results in tamper evident stressing of the plastics sheet material.

In another form of the invention the paths are formed by an intermittent seam line, with the portions of the seam substantially overlapping one another and providing tortuous flow paths between the first and second portions. The seam portions may be straight or curved or sinuous as desired.

The partitioning means may be formed by intermittently fusing the sides of the envelope by means of heat (i.e. welding), or by adhesive bonding, or mechanically, such as by stitching.

The primary container is preferably used with a dispensing apparatus that has a store of staining medium, means to pressurise the staining medium, and means to convey pressurised staining medium into the second portion. The conveying means may be a tube that is insertable into the second portion or an outlet that can be arranged to direct staining medium into the second portion.

This invention allows for the release of staining medium into the primary container without affecting the integrity of the material from which the primary container is made, i.e. it does not diminish the tamper evident security features of the primary container. The positioning of the path is designed to frustrate the various methods employed by criminals to penetrate the package, such as tweezers, hooks, wires and the like implements insertable into the first portion to snag currency and/or documents and withdraw them through any of the paths and then from the primary container.

Further features, variants and/or advantages of the invention will emerge from the following non-limiting description of examples of the invention made with reference to the accompanying schematic drawing.

DESCRIPTION OF ILLUSTRATED EMBODIMENTS

Figure 1:
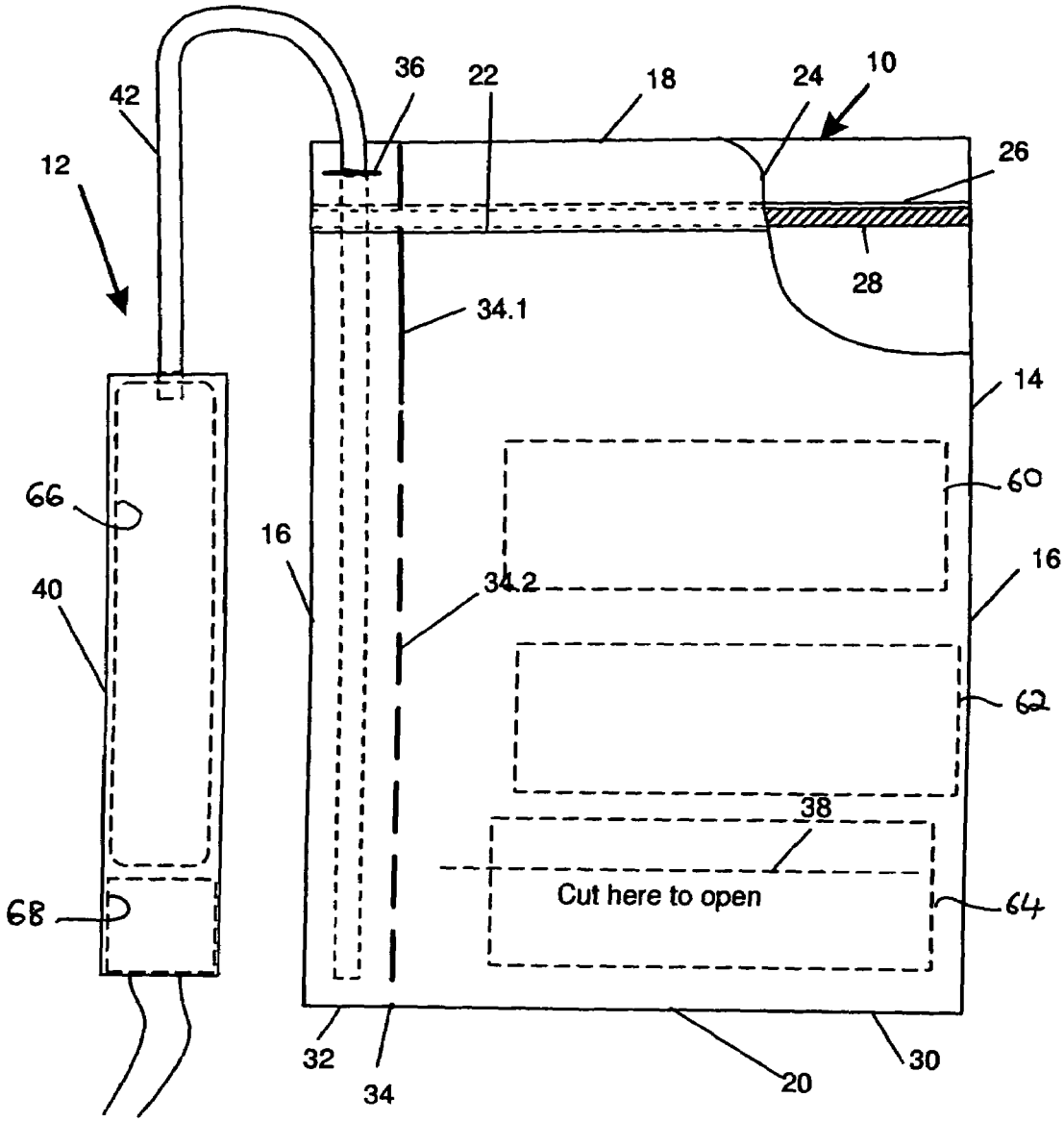
FIG. 1 shows a partly broken away, schematic side view of a primary container of the invention and means to inject staining medium into the container when desired.

FIG. 1 shows a primary container 10 to store and transport valuable articles as mentioned above and a stain dispensing apparatus 12 for introducing a suitable staining medium into the primary container when required.

The primary container 10 comprises a rectangular polyolefin envelope 14 with parallel side edges 16, a top edge 18 and a bottom edge 20. A primary opening 22 is formed near the top edge, the opening being constituted by a flap 24 extending from either side of the opening over the upper edge 26 of a side of the envelope. A strip of adhesive 28 or another piece of material is affixed to seal or close the opening 22. The envelope is partitioned into a first or valuables portion 30 and a second or stain dispensing portion 32 by a heat welded seam 34. The seam extends effectively over a portion of the distance between the top and the bottom edges. The seam has a continuous portion 34.1 and an intermittent portion 34.2 formed with spaced openings. A slit 36 or any other suitable shaped hole is formed into the staining portion of the envelope adjacent the top edge.

The length of the continuous portion and the width of the holes is designed to prevent documents, such as bank notes, from being rolled thereby aiding the withdrawal through the paths and slit/hole 36. The holes in this example are between about 2 and 4 mm wide, though they may range from about 2 mm adjacent the opening 36 to about 10 mm away from the opening so as to facilitate flow of staining medium between the first and second portions.

The stain dispensing apparatus 12 comprises a store 40 of staining medium and a tube 42 extending from the store to deliver staining medium to the second portion of the envelope.

The apparatus is used in practice to transport currency/documents by a courier/boxman/guard between business entities and the relevant vehicle. The currency is loaded into and sealed in the primary container by the business entity. The primary container is placed in the secondary container and simultaneously the free end of the tube 42 is inserted into the staining portion 32 at this stage. The secondary container is then carried to a depository, such as an armoured/secured/suitable/appropriate vehicle or bank/client where it is opened and the primary container removed so that the secondary container can be used for the next movement of the primary container. At the final destination the primary containers are delivered to a counting department. The primary containers are then opened by slitting them with a blade or other suitable cutting device along a marked designated line 38, so as not to separate/cut the piece of the primary container, so that, if needed, the primary container can be examined for evidence of tampering to determine liability for any shortfall. Any attempt by the courier to extract notes from the envelope would be evident. The continuous portion of the seam 34 is thus made sufficiently long to ensure such attempts will stress the slit or the seam.

In the event of an attempt to steal the secondary container, then the dispensing apparatus can be activated by suitable mechanical, motion sensitive, remotely actuatable and the like switches. Activation of any of the switches cause the store to release staining liquid into the second portion of the envelope and then through the paths in the seam into the first portion.

The system described above will enable secondary containers that have been activated to be cleaned and re-used after a fresh dispensing device has been installed—this is in contrast to heat systems where the secondary container becomes unusable once it has been activated. The primary container described above thus enables effective use of suitable or desired staining media without the use of heat. Secondary containers using such primary containers can now be cleaned and re-used.

Figure 2:
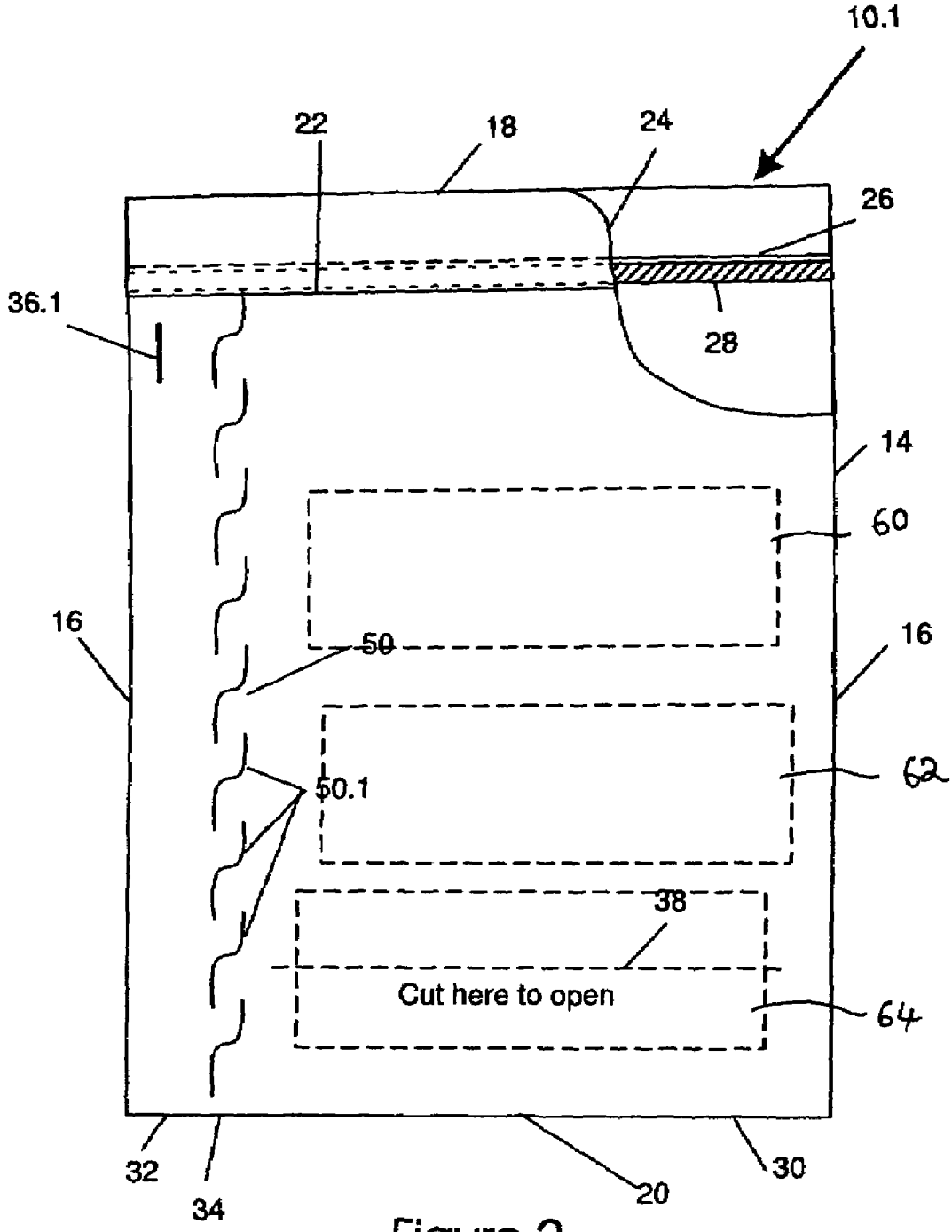
FIG. 2 shows another variant of the primary container of the invention.

FIG. 2 shows a variant 10.1 of primary container of the invention in which the same or similar parts have the same reference numbers. In this example an opening or slit 36.1 into the second portion extends parallel to one of the side edges. The first and second portions are separated by an intermittent seam 50 composed of S-shaped stitches 50.1 that overlap one another and form tortuous paths between the first and second portions. The first portion cannot be accessed through the opening 36.1 and the second portion without leaving evidence of tampering. The tortuous paths effectively enable free flow of staining medium between the first and second portions. The seam 50 may extend the full or partial distance from the adhesive 28 to the bottom edge, so that the opening to the first portion is effectively unrestricted. FIGS. 1 and 2 also show articles 60, 62 and 64 contained within the envelope 14. FIG. 1 shows the staining medium 66 in the store 40, and the means for pressurizing 68 the staining medium 66.

The invention is not limited to the precise details described above and shown in the drawings. Modifications may be made and other embodiments developed without departing from the spirit of the invention. For example, the primary container can be manufactured in a variety of colours and colour combinations as well as uncoloured, see-through materials and in different shapes. The surfaces of the primary container can be decorated/marked as desired. This invention is not restricted to any particular method of bag manufacturing or use of any particular stain dispensing apparatus or secondary container.

The invention claimed is:

1. A method of securing valuable articles within a tamper evident primary container (10), including the steps of:

partitioning the primary container into first (30) and second (32) portions that communicate with each other through at least one path (34.2) arranged to prevent undetectable access to the first portion (30) through the second portion (32);

inserting articles to be secured into the first portion (30) and sealing (26) at least that portion; and selectively dispensing a staining medium (12) into the second portion (32) from where it can flow into the first portion through the path (34).

2. A primary container (10) for articles to be secured comprising an envelope (14) with tamper evident features, a first opening (22) through which articles can be inserted into the envelope, and means (26) for sealing first opening, wherein partitioning means (34, 50) is provided to separate the envelope (14) into first (30) and second (32) portions that communicate with each other through at least one path (34.2, 50); and a second opening (36, 36.1) is formed into the second portion through which a staining medium is introduced into the second portion when desired.

3. The primary container as claimed in claim 2, wherein the path (34.2, 50) is constructed and arranged so as at least to inhibit access to the first portion (30) through the second portion (32).

4. The primary container as claimed in claim 2, wherein the path (34.2, 50) is constructed and arranged so as to ensure that access to the first portion through the second portion is detectable.

5. The primary container as claimed in claim 2, wherein the envelope (14) is substantially rectangular, the first opening (22) extends substantially parallel to one pair of opposed edges (18, 20) and the partitioning means (34, 50) extends substantially parallel to the other pair of opposed edges (16).

6. The primary container as claimed in claim 2, wherein the envelope (14) is substantially rectangular and the partitioning means (34) extends substantially from one of the edges (18) to the opposite edge (20).

7. The primary container as claimed in claim 2, wherein said at least one path includes a plurality of spaced apart paths (34.2, 50) formed through the partitioning means between the first and second portions.

8. The primary container as claimed in claim 7, wherein the paths (34.2, 50) are formed by the partitioning means which comprises an intermittent seam line.

9. The primary container as claimed in claim 8, wherein the intermittent seam line is formed by an intermittent joining method selected from: welding, stitching and bonding.

10. The primary container as claimed in claim 7, wherein the spaced apart paths are of substantially similar size (50).

11. The primary container as claimed in claim 10, wherein the lengths of the spaced apart paths (34.2, 50) are in the range of 2 to 20 mm.

12. The primary container as claimed in claim 10, wherein the lengths of the spaced apart paths (34.2, 50) are in the range of 2 to 4 mm.

13. The primary container as claimed in claim 7, wherein the spaced apart paths have openings which increase in size in a direction away from the second opening into the second portion.

14. The primary container as claimed in claim 13, wherein the lengths of the openings ranges from 2 to 50 mm.

15. The primary container as claimed in claim 13, wherein the lengths of the openings ranges from 2 to 20 mm.

16. The primary container as claimed in claim 13, wherein the partitioning means (34) is substantially continuous from the edge adjacent the second opening for a desired length and then is formed with the openings (34.2) to form the spaced apart paths.

17. The primary container as claimed in claim 7, wherein the path (50) is formed by the partitioning means which comprises an intermittent seam line (50.1), with the portions of the seam line substantially overlapping one another and providing tortuous flow paths between the first and second portions.

18. The primary container as claimed in claim 17, wherein the seam line portions (50.1) are selected from straight, curved and sinuous as desired.

19. The primary container as claimed in claim 2, wherein the relative configuration of the size of the second opening (36, 36.1) in the second portion (32), the width of the second portion (32) and the dimension of the openings (34.2, 50) between the first (30) and second (32) portions ensures that attempts to insert probes into the first portion through to the second portion results in tamper evident stressing of the envelope.

20. The primary container (10) as claimed in claim 2, wherein a dispensing apparatus (12) has a store of the staining medium, means to pressurise the staining medium, and means (42) to convey pressurized staining medium into the second portion (32) of the primary container.

* * * * *